US005810205A

United States Patent [19]

Kohen

[11] Patent Number: 5,810,205

[45] Date of Patent: Sep. 22, 1998

[54] DISPENSER FOR A COLLAPSIBLE TUBE

[76] Inventor: Nuri Kohen, 218-35 82nd Ave., Hollis Hills, N.Y. 11427

[21] Appl. No.: 851,884

[22] Filed: May 6, 1997

[51] Int. Cl.[6] ..... B65D 35/28

[52] U.S. Cl. ..... 222/103; 222/105

[58] Field of Search ..... 222/100, 101, 222/102, 103, 105

[56] References Cited

U.S. PATENT DOCUMENTS

| | | | |
|---|---|---|---|
| 1,799,678 | 4/1931 | Devlin | 222/103 X |
| 2,260,346 | 10/1941 | Spencer . | |
| 2,570,755 | 10/1951 | Booth | 222/96 |
| 2,596,683 | 5/1952 | Hawkins | 222/101 |
| 2,763,401 | 9/1956 | Buras, Jr. | 222/103 |
| 2,785,832 | 3/1957 | Verban et al. | 222/100 |
| 2,802,600 | 8/1957 | Burk | 222/100 |
| 2,805,662 | 9/1957 | Lawshe et al. | 222/103 X |
| 3,172,569 | 3/1965 | Wolford | 222/103 |
| 3,326,419 | 6/1967 | Zentner | 222/101 |
| 3,768,699 | 10/1973 | Robe, Jr. | 222/103 |
| 3,893,590 | 7/1975 | Paroussiadis | 222/103 |
| 3,993,220 | 11/1976 | Troy | 222/82 |
| 4,010,873 | 3/1977 | Mardirossian | 222/101 |
| 4,015,750 | 4/1977 | Wilston | 222/103 |
| 4,020,976 | 5/1977 | Mineo | 222/103 |
| 4,213,543 | 7/1980 | Thiem | 222/103 |
| 4,270,672 | 6/1981 | Kraals | 222/95 |
| 5,271,529 | 12/1993 | Stuber | 222/103 |
| 5,499,742 | 3/1996 | Ives, Sr. | 222/101 |

*Primary Examiner*—Kevin P. Shaver
*Attorney, Agent, or Firm*—Fish & Richardson P.C.

[57] ABSTRACT

A dispenser for a collapsible tube, such as a tube of toothpaste, is disclosed. The dispenser comprises a dispenser body which has a base, a pair of opposing sides and a stopper. The stopper extends across one end of the base and has an opening in it which is large enough that the neck of the tube can extend through it, but not large enough for the rest of the tube to pass through. A reversible push block is designed to engage the opposing sides of the dispenser body and to slide along the length of the base to come into contact with the tube and force out its contents. One edge of the push block is thinner than the other. The thinner edge is used when the tube still has much of its original contents. The thicker edge is used by reversing the push block and is used when the tube is nearly empty to force out the last bit of useable product.

9 Claims, 2 Drawing Sheets

DISPENSER FOR A COLLAPSIBLE TUBE

FIELD OF THE INVENTION

The present invention relates to the field of tube holders and dispensers for the contents of collapsible tubes.

BACKGROUND OF THE INVENTION

Products such as toothpaste and various creams, such as shampoos, hand creams and moisturizing creams, and some medicaments, are often packaged in collapsible tubes. Many of those tubes have flat back ends and have a cylindrical configuration near the front end. The front end of the tube usually terminates with an elongated neck which is smaller in diameter than the cylindrical portion near the front end. The neck is normally fitted with a screw-on cap or other such closure. When the cap is removed, the open end of the neck is the point from which the product discharges from the tube for application in the ordinary course of its use. Many such tubes are made from a pliable plastic material which one can squeeze by hand to force product out. These tubes usually do not hold their deformed configuration once the externally applied pressure is released, but rather spring back to approximately their original shape and condition.

Other tubes are constructed of a light weight metal, such as an aluminum compound, for example, and these tubes often do hold their deformed configurations once the applied pressure has been released.

For those tubes which spring back to their approximate original shape, the product they contain can once again spread out in the full volume of the tube. Over time, as the contents are used up, the small amount remaining in the tube can be hard to dispense for use by the usual method of applying finger pressure.

Similarly, even in cases where the tubes remain deformed, pockets of cream product may be scattered throughout the tube. Again, this makes it difficult when using ordinary finger pressure, to utilize all the product packaged in the tube.

Some attempts have been made previously to provide mechanical devices which can apply greater force or more evenly distribute the force applied, than is possible using one's fingers only. Thus, for example, U.S. Pat. No. 2,260,346 discloses a device for supporting a collapsible tube and for dispensing the contents thereof. U.S. Pat. No. 3,893,590 discloses a holder in which a tube can be placed and a member slidably mounted on the holder.

Even using such devices, however, it has been found that a substantial amount of product is wasted because it is still in the tube when the tube is discarded.

SUMMARY OF THE INVENTION

There is therefore a need for the device of the present invention. The device is designed to accept any size tube and provides for up to 97% evacuation of the contents of the tubes on which it is used.

The device of the present invention comprises a dispenser for a collapsible tube containing a cream product. The specific embodiments referred to herein will be referred to as dispensing toothpaste. However, it will be understood that the device of the invention can be used to dispense any creams or ointments which are packaged in collapsible tubes.

The dispenser of the invention comprises a dispenser body, which is formed to receive a collapsible tube, such as a toothpaste tube. Such tubes have a relatively flat back end and a relatively cylindrical front end adjacent the discharge port. The front end normally terminates with an extended neck which is normally closed by a screw-on cap. The dispenser body of the invention comprises a base, a pair of opposing sides substantially normal to the base and substantially parallel to one another, and a stopper. The stopper extends at a right angle to the dispenser body and has an opening to permit the neck of the tube to protrude.

A reversible push block is constructed with an underside which tapers more at one edge than at the other and is designed to engage the sides of the dispenser body to permit easy back and forth motion in the dispenser body.

DETAILED DESCRIPTION

Figure 1:
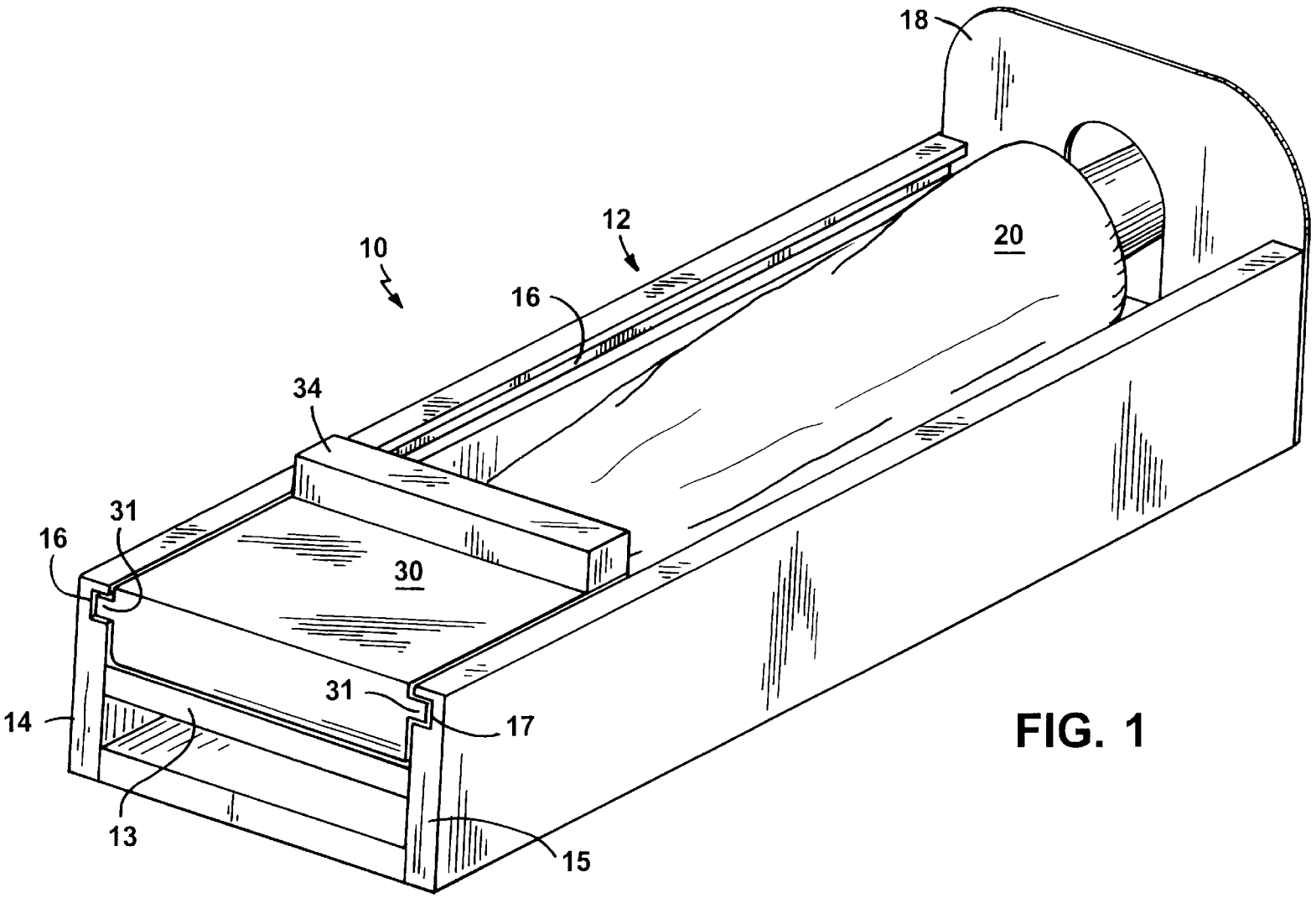
FIG. 1 is a perspective view of an embodiment of the invention.
Figure 2:
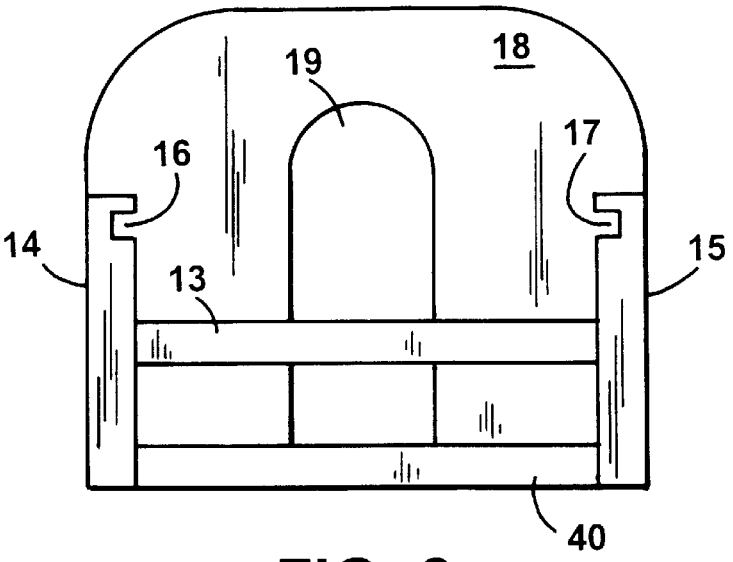
FIG. 2 is a view, partly in cross-section, of an embodiment of a stopper of the invention.
Figure 4:
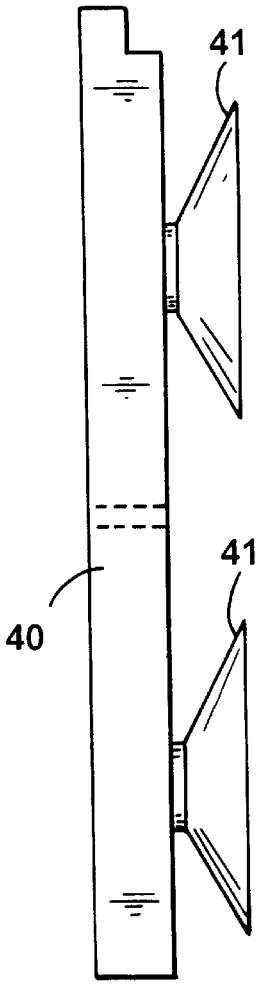
FIG. 4 is a view of an embodiment of a mounting plate fitted with suction cups.
Figure 3:
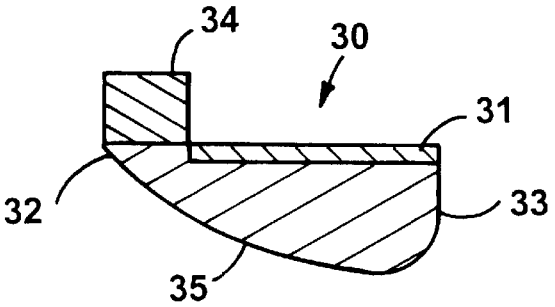
FIG. 3 is a cross-section of an embodiment of a push block of the invention.

Dispenser 10 comprises a dispenser body 12 which is shaped suitably for receiving a collapsible tube 20. Collapsible tube 20 can be any tube having a relatively flat back end and a relatively cylindrical front end with an extended neck closed by a cap. Tubes with which the invention is useful include plastic tubes and deformable metal tubes and can contain such products as toothpastes, tooth gels, shampoos, hand creams and the like. The products to be dispensed will normally not run freely, but will usually have the physical characteristics of a paste or gel. However, the uses of the device of the invention are not meant to be limited by the physical characteristics of the products being dispensed, as will be readily understood by those of ordinary skill in the art.

Dispenser 10 comprises dispenser body 12 which further comprises base 13, opposing sides 14, 15 which are attached to or formed integrally with base 13 and form right angles with the base 13. Sides 14, 15 are provided with grooves 16, 17 each of which cooperates with one or more protrusions 31 on push block 30.

Grooves 16, 17 run substantially the entire length of sides 14, 15 and provide for push block 30 to be moved along the entire length of dispenser body 12 in a path generally parallel to the plane of base 13.

Push block 30 has at least one protrusion 31 on each side. Protrusions 31 are designed to slidingly engage grooves 16, 17 to permit push block 30 to traverse the length of dispenser body 12. As will be readily understood by those of ordinary skill in the art, each side of push block 30 can have one or more than one protrusion 31 and the sides 14, 15 can be designed such that each has more than one groove 16, 17 therein. Protrusions 31 can, of course, be arranged side by side as well as one above the other on push block 30, as will be readily understood by those of ordinary skill in the art.

Push block 30 has a first edge 32 and a second edge 33 and can be provided with grasp bar 34. First edge 32 is substantially thinner than second edge 33. The underside 35 of push block 30 is tapered in the vicinity of first edge 32 and gradually becomes less tapered toward second edge 33 for reasons which will be explained further below.

Stopper 18 is positioned and attached at one end of the dispenser. Stopper 18 is provided with elongated opening 19. Opening 19 is sized to allow the extended neck and cap of tube 20 to protrude through it. In use, tube 20 is placed longitudinally within dispenser 10 and rests against base 13, with its neck and cap protruding through opening 19. However, opening 19 is also sized to prevent the relatively cylindrical front end of tube 20 from passing through opening 19. Instead, the front end of tube 20 abuts stopper 18.

If it is desired to affix the dispenser 10 to a surface, mounting plate 40 to which are attached suction cups 41 can be attached to the underside of the dispenser 10 such that the suction cups 41 can engage the surface to which the dispenser is to be affixed. Mounting plate 40 can be positioned within a hollowed out portion of base 13, for example, or can be attached to base 13. Preferably, sides 14, 15 extend beyond the underside of base 13 and mounting plate 40 can be attached at the bottom edges of sides 14, 15, such that the outermost surface of mounting plate 40 is substantially co-planar with the bottom edges of sides 14, 15. Suction cups 41 can be affixed to mounting plate 40 by screws, nails, rivets and the like.

If desired, instead of suction cups 41, an adhesive can be applied to the underside of mounting plate 40 or on landings which are surfaces adjacent mounting plate 40. The adhesive can be double sided adhesive tape, for example, or glue. The dispenser may also be screwed, nailed or otherwise affixed to a flat surface.

The dispenser can be made of plastic, wood or metal, as will be readily understood by those of ordinary skill in the art.

In operation, the dispenser can be mounted on a vertical wall or on a horizontal surface, such as a cabinet top. The tube 20 is placed along base 13 with the neck of the tube protruding through elongated opening 19. The opening can be large enough to allow passage of the tube neck with or without the cap on the tube. As will be readily understood by those of ordinary skill in the art, opening 19 should not be so large as to permit the cylindrical front end of the tube 20 to pass through. Rather, that portion of the tube is to be stopped by the stopper 18. If wall-mounted, dispenser 10 will be hung such that the stopper 18 is the lowest part of the device, with the extended neck of tube 20 protruding down through opening 19.

Once the tube 20 is placed in the dispenser, push block 30 cooperates with sides 14, 15 by the engagement of protrusions 31 in grooves 16, 17. When there is still a large quantity of product, such as toothpaste, in the tube 20, push block 30 is mounted such that first edge 32 faces toward stopper 18. As push block 30 advances in the dispenser, the cylindrical end of tube 20 is forced against stopper 18 and the underside 35 of push block 30 contacts a portion of tube 20 which is thereby forced against base 13. As the push block advances further, product in the tube will be forced toward the extended neck of the tube and, if the cap has been removed, will exit the tube.

As more and more product is thus dispensed, push block 30 will have to be moved within dispenser 10 closer and closer to the neck end of the tube 20 to force additional product out of the tube. When almost all product has thus been dispensed from tube 20, push block 30 is removed from the device, reversed, and re-inserted, this time with second edge 33 leading and facing stopper 18. Since second edge 33 is thicker then first edge 32, it will exert more force to the neck area of the tube than can first edge 32, thus forcing the last bit of useable product from the neck of the tube.

The device is designed to accept any size tube of a given product and can provide as much as 97% evacuation of the contents of the tube 20. As will be readily apparent to those of ordinary skill in the art, the underside 35 of push block 30 is dimensioned to force product out of tube 20 and to allow just enough clearance between underside 35 and base 13 to pass over the collapsed tube 20.

In using the device on a full tube 20 of product with first edge 32 of push block 30 facing toward stopper 18, the taper of underside 35 allows easy movement of push block 30 while still forcing out product. When push block 30 is reversed after nearly all the product has been forced from tube 20, second edge 33 then provides a thicker edge surface to force the last bit of product out through the neck of tube 20.

What is claimed is:

1. A dispenser for a collapsible tube, said dispenser comprising:

a dispenser body formed to receive a collapsible tube of a type having a relatively flat back end and a relatively cylindrical front end, the front end terminating in an extended neck, the dispenser body comprising a base, a pair of opposing sides substantially normal to the base and substantially parallel to one another, and a stopper;

the stopper extending substantially normal to the dispenser body and having an opening therein, sized such that the extended neck but not the cylindrical front end of the tube can pass through the opening;

the dispenser body being sized to engage a reversible push block such that when the push block is engaged it can traverse substantially the length of the dispenser body in a path substantially parallel to the plane of the base;

and the reversible push block having a first edge, an oppositely positioned second edge, two sides and an underside, the first edge being substantially thinner than the second edge, and the underside being tapered along the first edge and gradually becoming less tapered in the direction of the second edge, the push block being positioned, such that when the dispenser is in a first mode of operation, the first edge faces the stopper and when the dispenser is in a second mode of operation the second edge faces the stopper.

2. The dispenser of claim 1 wherein the push block further comprises at least one protrusion on each of the two sides, the protrusions cooperating with the sides of the dispenser body to provide for the push block to traverse substantially the length of the dispenser body.

3. The dispenser of claim 2 wherein the protrusions cooperate with grooves in the opposing sides of the dispenser body which extend substantially parallel to one another.

4. The dispenser of claim 1 further comprising fastening devices to attach the dispenser to a flat surface.

5. The dispenser of claim 4 wherein the fastening devices comprise adhesive.

6. The dispenser of claim 4 wherein the fastening devices comprise suction cups.

7. The dispenser of claim 1 further comprising a grasp bar on the push block.

8. The dispenser of claim 1 wherein the opening in the stopper is sized to allow a capped tube neck to pass through.

9. The dispenser of claim 6 wherein the suction cups are mounted on a mounting plate which is attached along an underside of the dispenser body.

* * * * *